US005829680A

United States Patent [19]

Perret, Jr.

[11] Patent Number: 5,829,680

[45] Date of Patent: Nov. 3, 1998

[54] TOOLLESS AIRLESS SPRAY HEAD

[76] Inventor: Robert J. Perret, Jr., 1828 Sequoia St., Orange, Calif. 92668

[21] Appl. No.: 871,706

[22] Filed: Jun. 9, 1997

[51] Int. Cl.[6] ..... B05R 15/02

[52] U.S. Cl. ..... 239/119; 239/288; 239/391; 239/600

[58] Field of Search ..... 239/104, 106, 239/116, 119, 223, 224, 288, 461, 463, 498, 581.1, 600, 391

[56] References Cited

U.S. PATENT DOCUMENTS

| | | | |
|---|---|---|---|
| 4,715,537 | 12/1987 | Calder | 239/119 |
| 4,757,947 | 7/1988 | Calder | 239/119 |
| 4,830,281 | 5/1989 | Calder | 239/119 |
| 5,294,053 | 3/1994 | Perret, Jr. | 239/119 |
| 5,379,938 | 1/1995 | Perret, Jr. | 239/119 |
| 5,379,939 | 1/1995 | Perret, Jr. | 239/119 |

*Primary Examiner*—Andres Kashnikow
*Assistant Examiner*—Lisa Ann Douglas
*Attorney, Agent, or Firm*—Robert E. Strauss

[57] ABSTRACT

There is disclosed an airless spray head having a rotatable turret orifice tip holder with a floating turret seal preloaded with a compression spring within a spray head body having a distal circular rim, a through longitudinal passageway and an intersecting orthogonal bore which receives the cylindrical turret. A retainer nut surrounds and receives the spray head body which is captured by the circular rim, and a low friction washer is located between the rim and the retainer nut. The compression spring is biased against the upstream face of the turret seal by a spring retainer with a boss on its downstream face and an annular groove on its upstream face in which an annular sealing washer is permanently received. The compression spring is mounted on the downstream boss and retained thereon by spring detents of the boss. A second annular sealing washer is located between the downstream face of the retainer and the end of the spray head body. The seals of this spray head are compressed entirely by hand tightening of the retainer nut and the spray head can be easily disassembled and components replaced by loosening of the retainer nut.

9 Claims, 6 Drawing Sheets

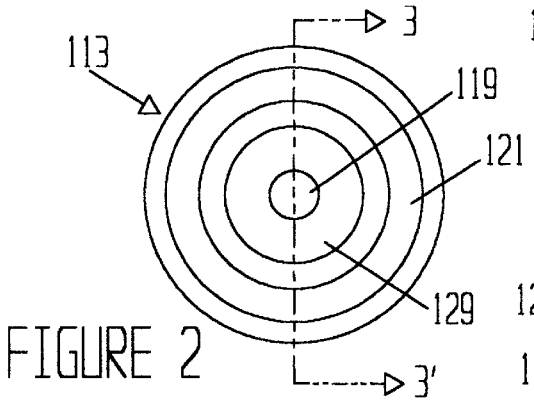
FIGURE 2
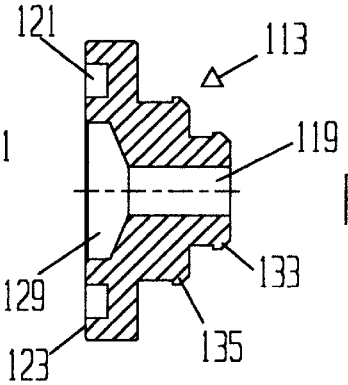
FIGURE 3
FIGURE 4
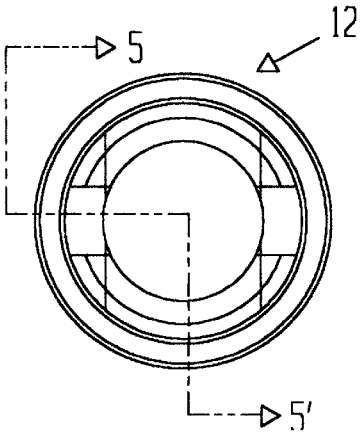
FIGURE 5
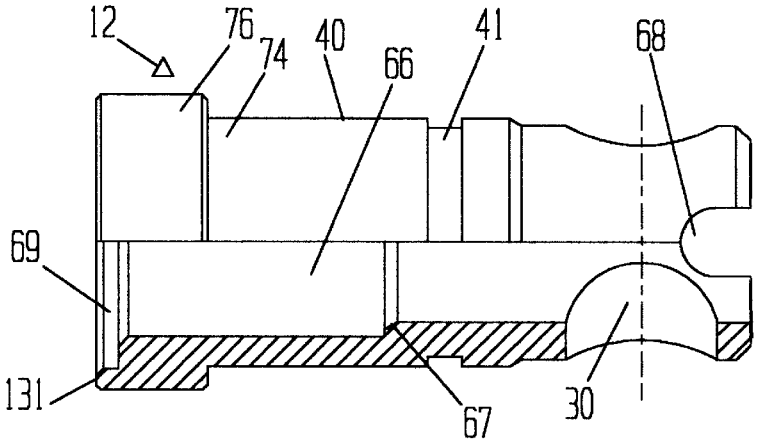

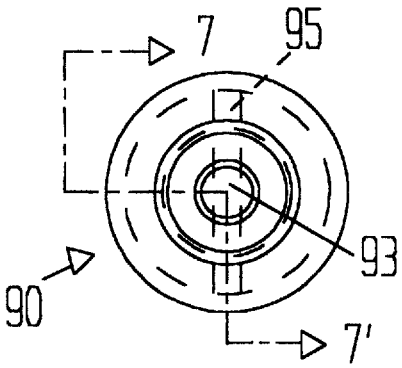
FIGURE 6
FIGURE 7
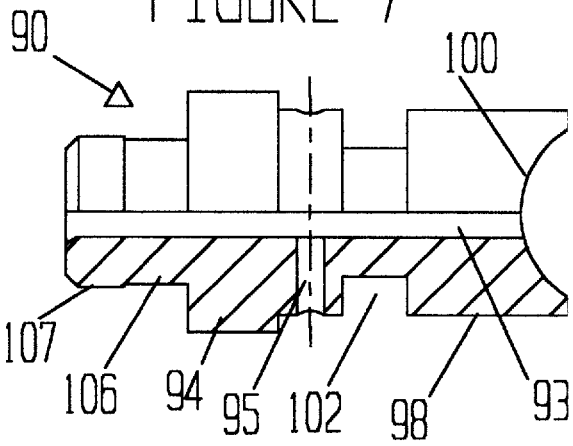
FIGURE 8
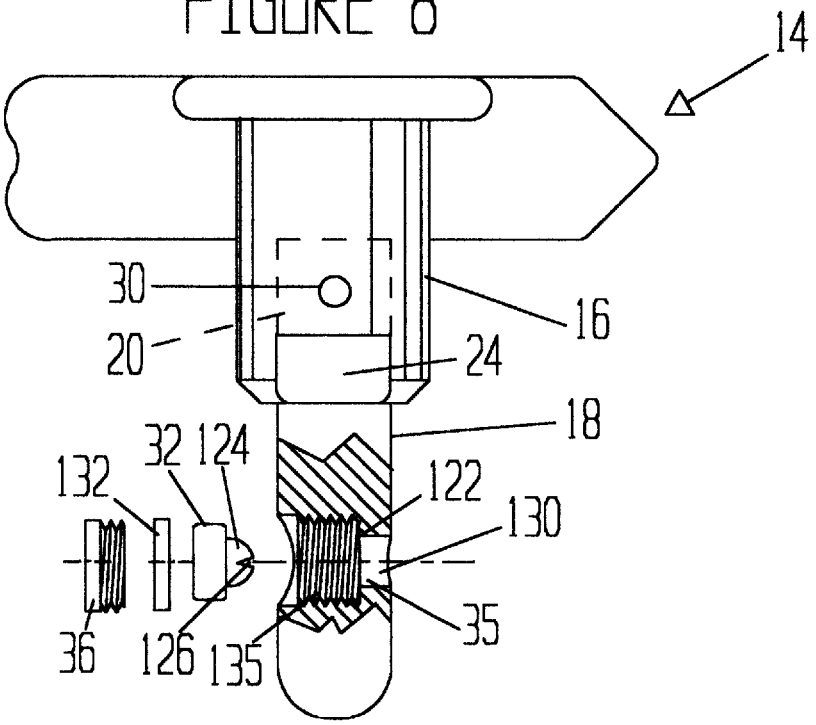

FIGURE 9
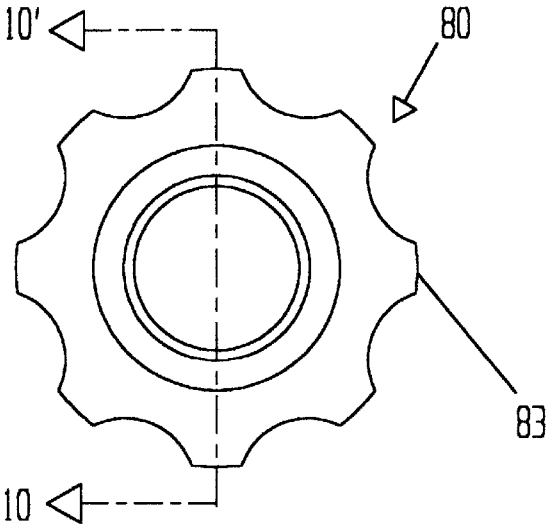
FIGURE 10
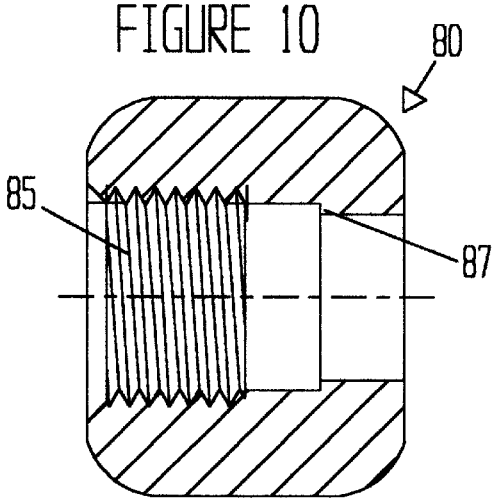
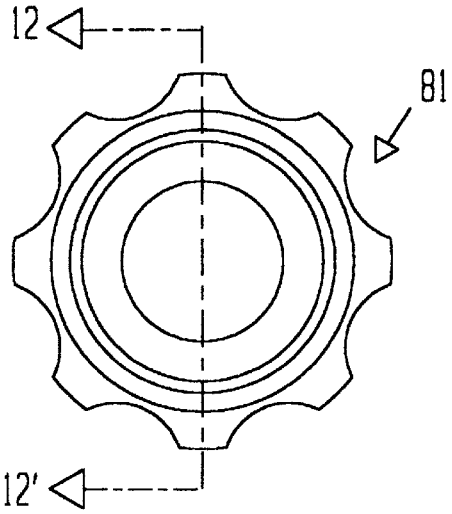
FIGURE 11
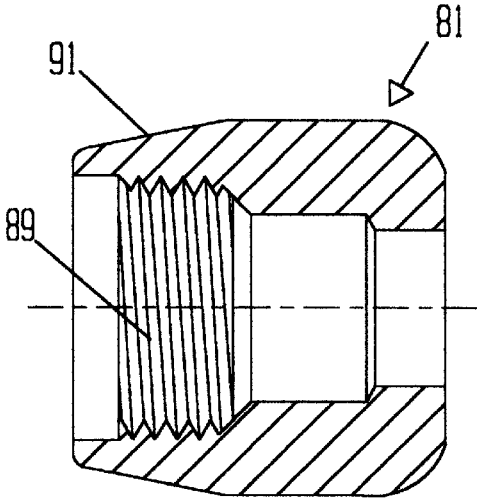
FIGURE 12

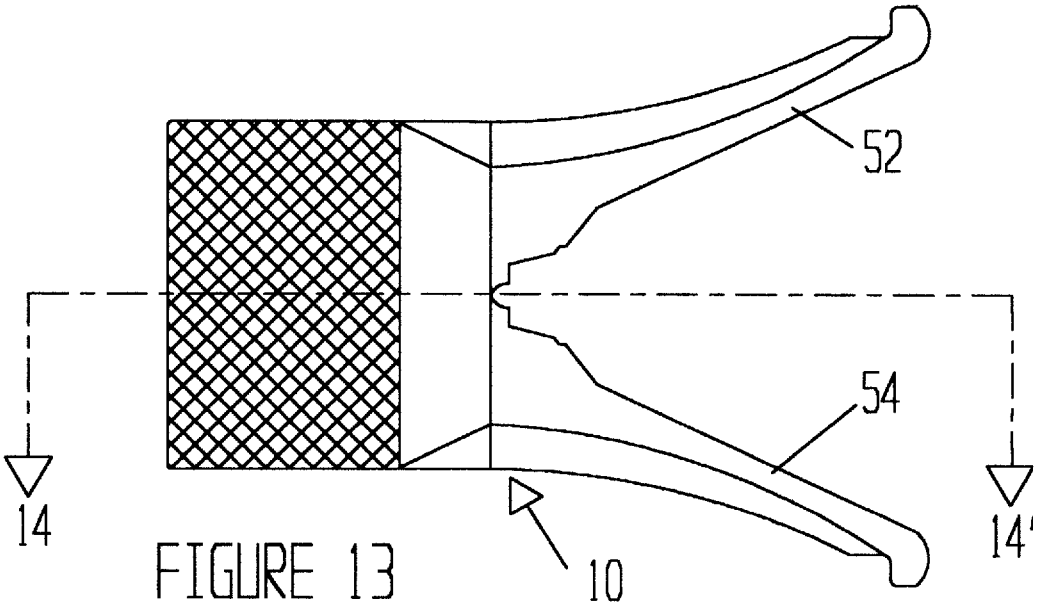
FIGURE 13
FIGURE 14
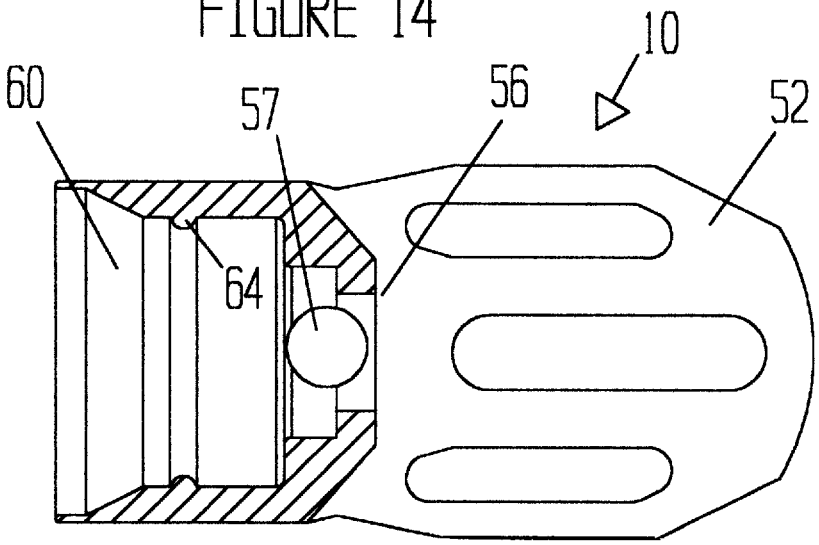

TOOLLESS AIRLESS SPRAY HEAD

BACKGROUND OF THE INVENTION

1. Field of Invention

This invention relates to a spray head for airless spraying and, in particular, to a spray head which can be mounted on a spray gun and its components replaced without use of a tool, i.e., a toolless, or entirely hand tight, spray head.

2. Brief Statement of the Prior Art

The field of airless spraying and equipment used has been well established over many decades of use. Typically, paints, stains, lacquers, etc., are sprayed at high pressures, usually from 2,000 to 5,000 psi, through a minute orifice having a shape and configuration which imparts a desired spray pattern to the discharge. Because of the abrasive nature of the liquid and the relatively high pressures employed, parts which are subjected to highly abrasive conditions, such as the orifice tip member, are formed of very high wear-resistant material, e.g., tungsten carbide and the like.

The small diameter orifice of the orifice tip member unavoidably clogs during painting and a universal design has been to mount the carbide tip member in a cylindrical turret which can be rotated to reverse the carbide tip member between spraying and cleaning positions. The turret is sealed against leakage with a turret seal which is compressed against the cylindrical body of the turret.

A number of designs have been proposed in the search for a spray head that is truly toolless which permits replacement of its components and attachment to the spray gun entirely by hand tightening of a retainer nut. One advance, disclosed in U.S. Pat. No. 4,715,537, is to use a "floating" turret seal which applies the line pressure of the liquid being sprayed to compress the face of the seal against the rotatable turret. This advance, along with other improvements is also disclosed in the following U.S. Pat. Nos. 5,294,053, 4,830,281 and 4,757,947. While the floating seal was a major accomplishment towards achieving an effective hand tight design, the spray head of this patent was not completely sealed against leakage at the highest line pressures encountered in spraying applications.

Additional improvements in the spray head led to the employment of threaded retainers to preload the turret seal, as in U.S. Pat. Nos. 5,379,938 and 5,379,939. A threaded seal spring retainer was also used in a commercial embodiment of the floating seal spray head. The disadvantage of using a threaded seal retainer or seal spring retainer is that assembly and disassembly of the retainer requires use of a wrench, and the goal of an entirely toolless or hand tight spray head has remained elusive.

OBJECTIVES OF THE INVENTION

It is an objective of this invention to provide an improved spray tip head for airless spraying.

It is a further objective of this invention to provide an entirely toolless spray head for airless spraying.

It is an additional objective of this invention to provide an airless spray tip head with a turret spray tip holder that can be hand turned between spraying and cleaning positions and resistant to seal leakage during cleaning and spraying operations.

It is likewise an object of this invention to provide an airless spray tip head which can be rotated without loosening of its assembly to the spray gun on which it is mounted to permit changing of the spray pattern, i.e., capable of a "toolless" directional change.

It is still an additional object of this invention to provide an improved spray head in which all the components are restrained in a single assembly during attachment to, and removal from, a spray gun.

It is still a further object of this invention to provide an improved spray head which can be attached and removed from a spray gun entirely by hand, without use of any tool.

It is likewise an object of this invention to provide an improved spray head with components that can be replaced entirely by hand, without use of any tool.

Other and related objects will be apparent from the following description of the invention.

BRIEF DESCRIPTION OF THE INVENTION

This invention comprises an airless spray head having a rotatable turret orifice tip holder with a floating turret seal preloaded with a compression spring within a spray head body having a distal circular rim, a through longitudinal passageway and an intersecting orthogonal bore which receives the cylindrical turret. A retainer nut surrounds and receives the spray head body which is captured by the circular rim, and a low friction washer is located between the rim and the retainer nut. The compression spring is biased against the upstream face of the turret seal by a spring retainer with a boss on its downstream face and an annular groove on its upstream face in which an annular sealing washer is permanently received. The compression spring is mounted on the downstream boss and retained thereon by spring detents of the boss. A second annular sealing washer is located between the downstream face of the retainer and the end of the spray head body. The seals of this spray head are compressed entirely by hand tightening of the retainer nut and the spray head can be easily disassembled and components replaced by loosening of the retainer nut.

BRIEF DESCRIPTION OF THE DRAWINGS

The invention will now be described with reference to the FIGS. of which:

FIGS. 2 and 3 illustrate the spring retainer used in the spray head of the invention, FIG. 3 being a view along line 3–3' of FIG. 3;

FIGS. 4 and 5 illustrate the spray head body used in the spray head of the invention, FIG. 5 being a view along line 5–5' of FIG. 4;

FIGS. 6 and 7 illustrate the floating seal used in the spray head of the invention, FIG. 7 being a view along line 7–7' of FIG. 6;

FIG. 8 is a partial cross section view of the cylindrical turret used in the spray head of the invention;

FIGS. 9 and 10 illustrate the retainer nut used in the spray head of the invention, FIG. 10 being a view along line 10–10' of FIG. 9;

FIGS. 11 and 12 illustrate an alternative retainer nut used in the spray head of the invention, FIG. 12 being a view along line 12–12' of FIG. 11;

FIGS. 13 and 14 illustrate the spray guard used in the spray head of the invention, FIG. 14 being a view along line 14–14' of FIG. 13.

DESCRIPTION OF PREFERRED EMBODIMENT

Figure 1:
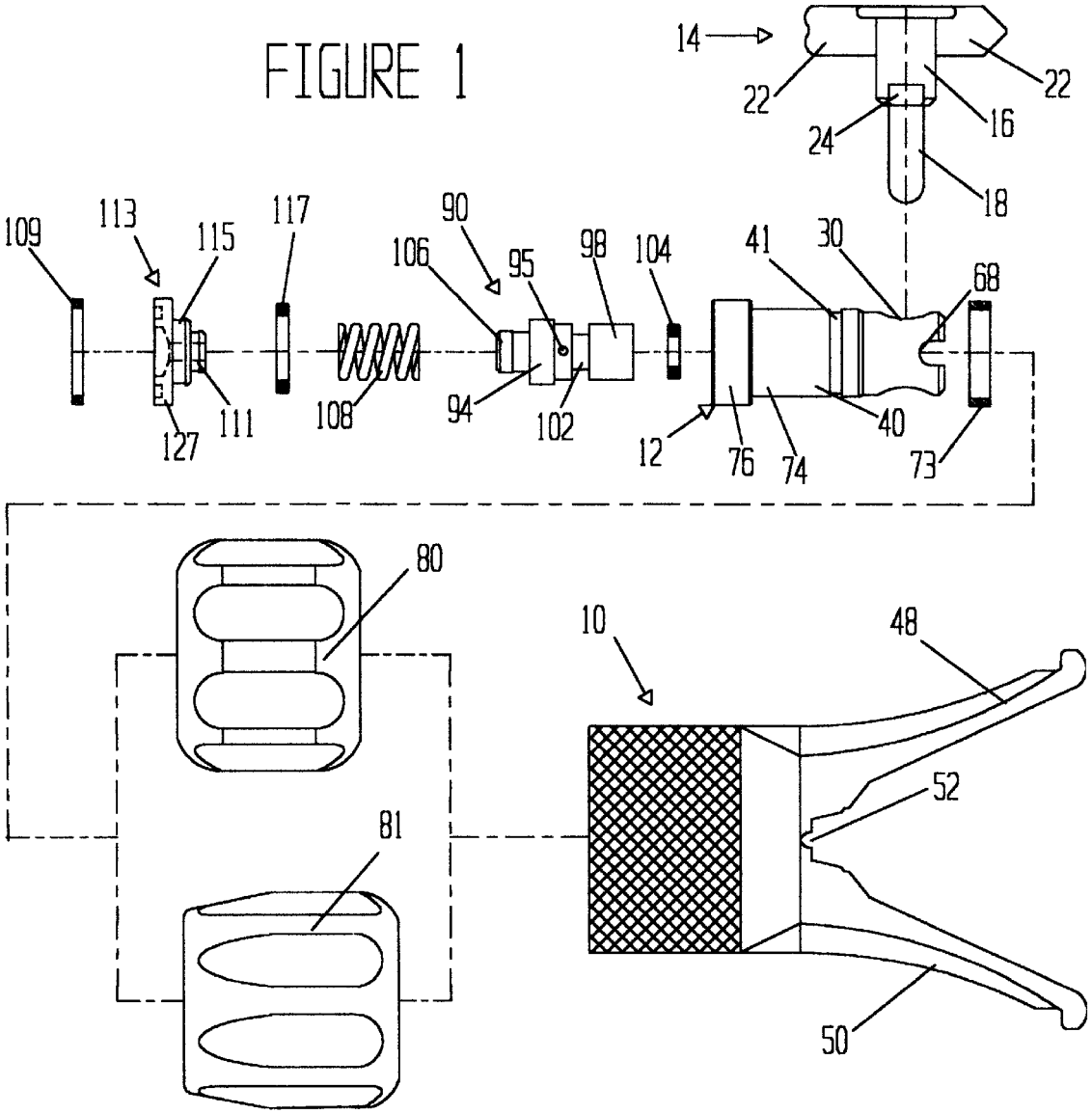
FIG. 1 is an exploded view showing the components of the spray head of the invention.

Referring now to FIG. 1, the spray head with which the orifice tip holder of the invention is used is shown with the various interchangeable components in exploded view. The spray head includes a spray guard 10 which mounts on a tubular housing 12 that supports a turret subassembly 14. The turret subassembly 14 is formed of a handle 16 which is dependent from cylindrical orifice tip holder 18. The upper end 20 of orifice tip holder 18 is press-fitted into a central bore in the underside of handle 16. The handle 16 has a pair of ears 22, and a radial prong 24 at its base. As described in greater detail with reference to FIG. 8, the orifice tip holder 18 carries an orifice tip.

The spray guard 10 has a body 40 with an aperture to receive the base of handle 16. The spray guard 10 has a central longitudinal, cylindrical cavity that receives the tubular body 40 of the housing 12. At its forward end, the spray guard 10 has a pair of outwardly diverging wings 48 and 50 which are generally trapezoidal. At the apex or intersection of wings 48 and 50, the spray guard has slots 52 on each side.

The tubular housing 12 has a longitudinal through passageway, and a cylindrical bore 30 orthogonal to and intersecting the longitudinal through passageway and this cylindrical bore 30 receives the cylindrical orifice tip holder 18. At its forward end, the housing 12 has arcuate slots 68 at each side which align with the slots 52 in the spray guard body 40 to provide clearance of the spray discharged from the spray head. The housing 12 has an annular groove 41 at its mid-length which receives a detenting rib which is molded on the inside wall of the spray guard 12, thereby firmly securing the subassembly of housing 12 and spray guard 10. At its upstream end 74, housing 12 has an annular flange 76. A washer 73, preferable of Nylon, is received over the body 40, and the spray tip head is retained on the externally threaded barrel of a spray gun by either of two retainer cap nuts 80 and 81.

The central through passageway of the housing body 40 receives the floating piston seal 90. The floating piston seal 90 comprises a sleeve body 94 with a through passage. At its forward end, the sleeve body 94 terminates in turret seal 98. The seal 98 has a cylindrically concave face to mate with the cylindrical contour of orifice tip holder 18. Sleeve body 94 has as annular groove 102 which receives an annular resilient sealing member, preferably an O-ring 104 to seal the floating piston in the longitudinal through passageway of housing 12. The sleeve body 94 also has a cross passage 95 which intersects the central through passage. The upstream end of sleeve body 94 has a reduced diameter neck 106 and a compression spring 108 is received over this neck. Preferably neck 106 has a spring detent in the form of an annular flange 107 permitting the spring 108 to be pressed onto the neck 106 and retained thereon in a yielding restraint, i.e., a restraint which can be overcome by hand force, but which is sufficient to prevent the spring from becoming dislodged during packaging, shipping and handling of the spray head.

The upstream end of the spring 108 is received on the boss 111 of retainer 113. The retainer is a circular plate 127 having a through passage and stepped bosses 115 and 111 on its downstream face. A sealing gasket 117 is received on boss 115. An annular seal 109 is permanently seated in an annular groove on the upstream face of retainer 113, i.e., is locked in a groove sufficiently to require tools for removal.

Referring now to FIGS. 2 and 3, the retainer 113 will be described in greater detail. The through passage 119 of the retainer 113 has an enlarged diameter entrance port 129 on its upstream face 123 and a constant diameter sufficient to avoid clogging with most liquids, e.g., about 0.05 to 0.15 inch. The annular groove 121 on the upstream face 123 of the circular plate 127 receives the annular seal 109, as previously mentioned. On its downstream face, the retainer has two, stepped cylindrical bosses. The larger boss 115 receives the sealing gasket 117 (see FIG. 1) and has a distal rim 135 to capture the gasket in a yielding restraint. The smaller boss 111 receives the upstream end of compression spring 108, which is yieldingly restrained thereon by a spring detent formed as an annular rim 133. Preferably, the end of the boss 111 is chamfered, as shown for ease of assembly of the spring 108 onto the boss 111.

Referring to FIGS. 4 and 5, the body 40 of the housing 12 is shown in partial cross-section. The body is tubular, preferably cylindrical, and has a longitudinal through passage 66 which decreases in diameter approximately at the middle of the body 40, with a chamfered internal shoulder 67 between the smaller and larger diameters portions of the passage. The upstream face 131 of the body has an annular recess 69, which receives the sealing gasket 117 that is compressed between the downstream face of the retainer 113 and the upstream face 131 of body 40. The intersecting orthogonal cylindrical bore 30 is located at the downstream end of the body 40, which also has the aforementioned arcuate slots 68.

FIGS. 6 and 7 illustrate the floating seal 90, which is shown rotated a quarter turn (90°) from its position in FIG. 1. The floating seal 90 has a turret seal 98 on its downstream end, which has a cylindrically concave face 100, conforming to the cylindrical barrel 18 of the turret 14. The term "floating seal" is used herein to indicate that the seal "floats" on the line pressure of the spray liquid which, with the additive force of spring 108, forces the cylindrically concave face 100 of the turret seal 98 against the side of the cylindrical barrel 18 of the turret 14. The floating seal 90 has a central through passage 93 of constant diameter which is intersected by a cross passage 95 at approximately the mid-length of the seal. The floating seal 90 has an annular groove 102 which provides a seat for annular sealing washer 104 (see FIG. 1). At its upstream end, the floating seal has a cylindrical neck 106 with a distal annular flange 107 to provide a retainer for the downstream end of spring 108, which is pressed over flange 107.

Referring now to FIG. 8, the turret 14 will be described. This turret 14 is illustrated in partial sectional and exploded view in FIG. 8. The orifice tip holder 18 is cylindrical body which is indexed to a precise position in handle 16 by alignment of a transverse bore in its upper end 20 with a mating bore in the handle, and a roll pin 30 can be used to complete the assembly.

The orifice tip holder 18 has a transverse through bore 35 which is counterbored and internally threaded at 135, providing an interior annular shoulder 122. The orifice tip member 32 is a conventional cylindrical member formed of a hard, abrasion resistant material such as tungsten carbide. This member has a discharge face supporting a hemispherical boss 124 that has a V-groove 126 intersecting a minute through passageway (not shown). The diameter of the hemispherical boss 124 is slightly less than the diameter of the small diameter portion 130 of through bore 35 and the length of the small diameter portion 130 of the transverse bore 35 in the cylindrical body 18 is approximately the same distance as the elevation of the hemispherical tip 124 from its cylindrical body.

The orifice tip member 32 is received in the large diameter threaded counterbore 135 of the transverse bore 35 of orifice tip holder 18 with the hemispherical boss 124 projecting into the small diameter portion 130 of the transverse bore 35.

A sealing washer 132 formed of a resilient, compressible material is received in the counterbore 135, and a cylindrical retainer plug 36 is threaded into the enlarged diameter counterbore 135 of the through bore 35.

FIGS. 9 and 10 illustrate a suitable retaining nut 80 which has an exterior surface having axial ribs 83 useful to provide gripping surfaces. The retaining nut 80 has internal threads 85 for engagement with the externally threaded end of a diffuser of a spray gun and is counterbored to form an internal annular shoulder 87 that is received against the Nylon washer 73 as the retaining nut 80 is received over the annular external flange 76 on the upstream end 74 of the housing body 40.

FIGS. 11 and 12 illustrate an alternative retaining nut 81 which has internal threads 89 corresponding to alternate spray gun diffuser thread patterns, and has a slightly longer body with a tapered upstream end 91. It receives and captures the housing body in the same manner as that shown in FIGS. 9 and 10.

FIGS. 13 and 14 illustrate the spray guard 10 used in the invention. The spray guard has a pair of diverging wings 52 and 54 and has a central cavity 56 (see FIG. 14) that receives the turret assembly 14. The spray guard has a longitudinal chamber 60 which is received over the downstream end of the housing body 40 and has an orthogonal, cylindrical recess 57 to receive the turret assembly 14. The housing body 40 has an annular groove 41 for seating an internal rib 64 of the spray guard.

The spray head is assembled to a spray gun by the retainer nut 80 or 81, which is tightened onto the threaded barrel of a spray gun or spray gun diffuser. The compression spring 108 bears against the retainer 113 and applies a resilient force to the upstream end of the floating seal 90.

The seal washer 109 is formed of a suitable low frictional characteristic plastic, e.g., Teflon, Nylon, etc, and is permanently seated in annular groove 121 on the face of the retainer 113; see FIG. 3. This washer effectively seals against liquid escaping from the through passage 119 of the retainer. Additionally, the sealing gasket 117 on the downstream face of the retainer is compressed in the annular groove 69 on the upstream end 131 of the housing body 40 (see FIG. 5, thereby preventing liquid from escaping from the housing body 40.

When the spray head is removed from a spray gun, the retainer 113 and its annular seal 109, spring 108 and sealing gasket 117 remain as a single assembly since the opposite ends of spring 108 are restrained on the neck 106 of housing body 40 and on the boss 111 of retainer 113. The single assembly of these elements also remains in the body 40, restrained therein by the compressive action of the O-ring 104 about the seal 90. The restraint is sufficient to prevent accidental dislodgement of the assembly from the body and accidental disassembly of the retainer 113, annular seal 109, spring 108 and gasket 117. When necessary, however, these parts can be readily separated or disassembled.

Figure 15:
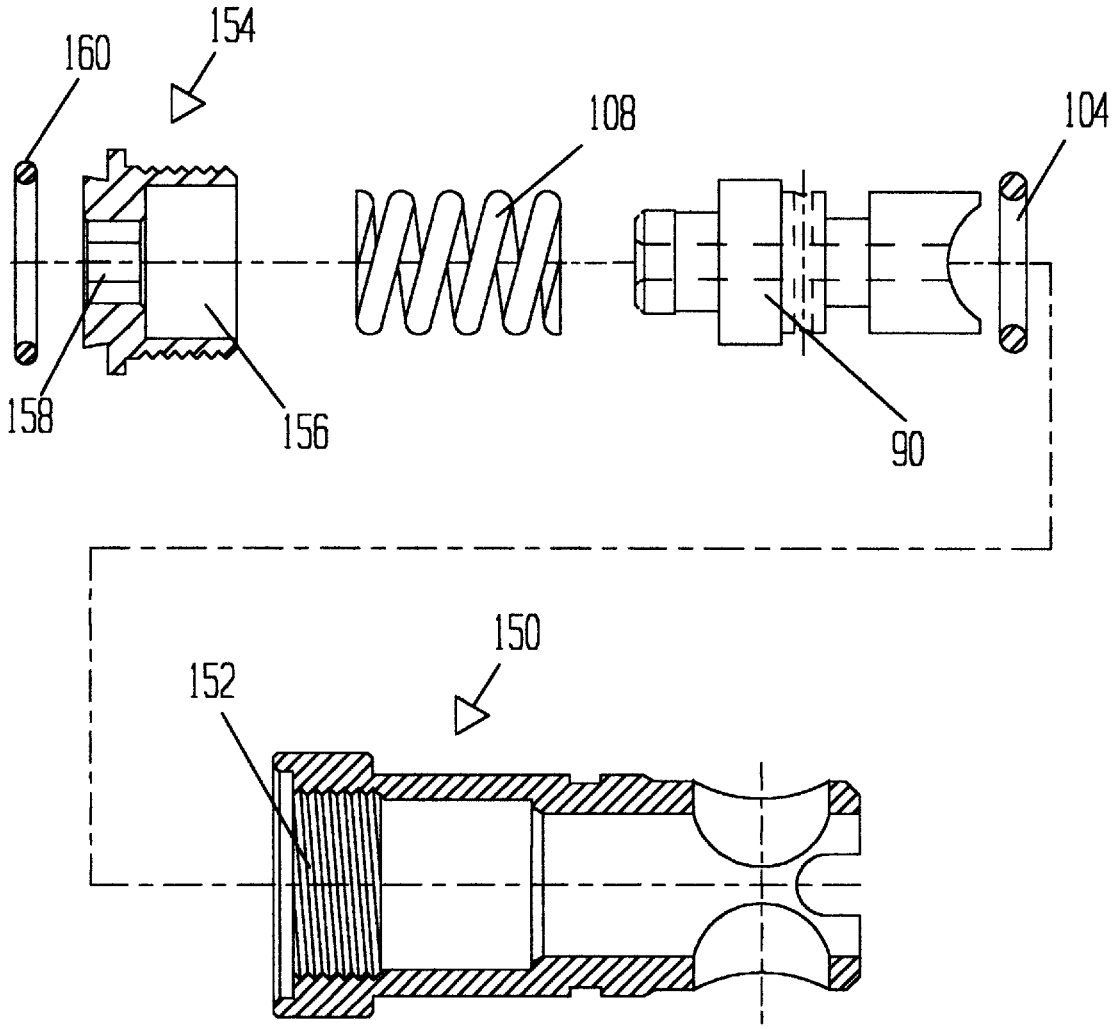
FIGURE 15 PRIOR ART
FIG. 15 illustrates a prior art commercial embodiment of a floating seal spray head.

Portions of a prior commercial embodiment of a spray head with a floating seal are shown in FIG. 15. As there illustrated, the housing body 150 was of similar configuration to housing 40 of this invention, however, the upstream end of the body 150 had internal threads 152 that received the threaded end of a retainer 154. A Nylon O-ring 160 was received over the upstream end of the retainer 154. The floating seal 90 was substantially similar to that used in this invention with an O-ring 104 that sealed inside the body 150. A compression spring 108 was received in a recess 156 in the downstream end of the retainer 154. The retainer 154 had a hexagonally broached passage 158 which required use of an Allen wrench for assembly and disassembly of the spray head when replacing the spring 108 or seal 90. When disassembled, the retainer and the seal washer 160 were not restrained in an assembly, furthering loss of these components during assembly or attachment of the spray head to a spray gun.

The invention achieves true hand tight, or toolless, operation, as the retainer nuts can be engaged and tightened by hand to apply sufficient compressive loading to its internal seals that liquid does not leak from the spray head even at very high spraying pressures. Additionally, the user can readily rotate the turret 14 between cleaning and spraying orientations without loosening of the retainer nut, and without resort to the use of tools.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. In a spray tip having a body with a distal circular rim, a through longitudinal passageway, an intersecting orthogonal bore with a cylindrical turret having a transverse passageway containing a spray orifice and rotatably received in said orthogonal bore, an axially slidable seal received in said longitudinal passageway and having a cylindrically concave downstream face which is received against the cylindrical turret and a through passage aligned with said transverse passageway of said turret, a spring biased against the upstream face of said seal to compress said seal against said turret, the improvement which comprises:

a. a spring retainer including a circular plate with a concentric cylindrical boss on its downstream face and an annular groove on its upstream face;

b. a first annular sealing washer permanently received in said annular groove;

c. a second annular sealing washer received against the downstream face of said circular plate; and d. a spring detent on said boss that yieldably captures the upstream end of said spring.

2. The spray tip of claim 1 including a retainer nut surrounding and receiving said body and captured thereon by said distal circular rim, and a low friction washer between said rim and said retainer nut.

3. The spray tip of claim 1 wherein said spring retainer has a first, large diameter boss and a second small diameter boss, and wherein said second annular sealing washer is received on said first, large diameter boss and said spring is captured on said, second, small diameter boss.

4. The spray tip of claim 3 wherein said spring detent comprises a second annular groove surrounding said second, small diameter boss.

5. The spray tip of claim 4 including a bevel on the downstream edge of said small diameter boss.

6. The spray tip of claim 1 wherein said first, large diameter boss has an external annular groove which receives said second annular sealing washer.

7. The spray tip of claim 1 wherein said spring is a helical compression spring.

8. The spray tip of claim 1 wherein said axially slidable seal has a tubular seal body extending upstream from said seal face and including an annular seal surrounding said seal body and bearing against said longitudinal passageway.

9. The spray tip of claim 4 including an second annular groove about said tubular sealing washer body that receives said annular seal.

* * * * *